US008875952B2

(12) United States Patent
Ciavarella et al.

(10) Patent No.: US 8,875,952 B2
(45) Date of Patent: Nov. 4, 2014

(54) AIR-ACTIVATED SEQUENCED VALVE SPLIT FOAM PUMP

(75) Inventors: Nick E. Ciavarella, Seven Hills, OH (US); James M. Yates, Akron, OH (US); Todd A. Spiegelberg, North Ridgeville, OH (US); John J. McNulty, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 40 days.

(21) Appl. No.: 13/417,469

(22) Filed: Mar. 12, 2012

(65) Prior Publication Data

US 2013/0233441 A1 Sep. 12, 2013

(51) Int. Cl.
*B67D 7/76* (2010.01)

(52) U.S. Cl.
USPC ..... 222/190; 222/401; 222/145.5; 222/207; 222/209; 222/631

(58) Field of Classification Search
USPC ..... 222/190, 135, 133, 129.2, 145.1, 145.5, 222/195, 206, 207, 209, 631, 632, 145.6, 222/401; 141/18; 417/118
See application file for complete search history.

(56) References Cited

U.S. PATENT DOCUMENTS

| | | | | |
|---|---|---|---|---|
| 4,147,476 | A | 4/1979 | Warren | |
| 4,957,218 | A | 9/1990 | Ford, Jr. | |
| 5,339,988 | A | 8/1994 | Palmer et al. | |
| 5,398,845 | A * | 3/1995 | Meyer | 222/1 |
| 5,445,288 | A | 8/1995 | Banks | |
| 5,462,208 | A | 10/1995 | Stahley et al. | |
| 5,984,146 | A | 11/1999 | Kaufman | |
| 6,082,586 | A | 7/2000 | Banks | |
| 7,431,182 | B2 | 10/2008 | Ciavarella | |
| 7,537,140 | B2 | 5/2009 | Lin | |
| 7,543,722 | B2 | 6/2009 | Yates et al. | |
| 7,708,166 | B2 | 5/2010 | Ophardt | |
| 7,770,874 | B2 | 8/2010 | Ophardt et al. | |
| 7,780,039 | B2 | 8/2010 | Criswell et al. | |
| 7,823,751 | B2 | 11/2010 | Ophardt et al. | |
| 7,861,895 | B2 | 1/2011 | Ray | |
| 7,874,463 | B2 | 1/2011 | Ciavarella | |
| 8,047,403 | B2 | 11/2011 | Quinlan et al. | |
| 8,047,404 | B2 | 11/2011 | Quinlan et al. | |
| 2003/0000967 | A1 * | 1/2003 | Ehrensperger et al. | 222/190 |
| 2005/0258192 | A1 * | 11/2005 | Matthews et al. | 222/190 |
| 2006/0048843 | A1 | 3/2006 | Yerby et al. | |
| 2007/0194054 | A1 | 8/2007 | Ganzeboom | |
| 2008/0237266 | A1 | 10/2008 | Ciavarella et al. | |

(Continued)

FOREIGN PATENT DOCUMENTS

| | | |
|---|---|---|
| WO | 95/26831 | 10/1995 |
| WO | 2009/184134 | 11/2009 |

*Primary Examiner* — Frederick C Nicolas
*Assistant Examiner* — Bob Zadeh
(74) *Attorney, Agent, or Firm* — Calfee, Halter & Griswold LLP

(57) ABSTRACT

Foam dispenser systems and pumps for use in foam dispenser systems are disclosed herein. A refill unit for refilling a foam dispenser system comprises a container for holding a supply of foamable liquid and a pump housing connected to the container. The pump housing comprises one or more connections for connecting to one or more external air pumps, wherein the air pumps supply air pressure to move the foamable liquid into a mixing chamber and to mix air with the liquid in the mixing chamber and create a foamy air-liquid mixture.

20 Claims, 7 Drawing Sheets

(56) References Cited

U.S. PATENT DOCUMENTS

| | | | | |
|---|---|---|---|---|
| 2009/0184134 | A1 | 7/2009 | Ciavarella et al. | |
| 2009/0184136 | A1 | 7/2009 | Ciavarella | |
| 2009/0194563 | A1 | 8/2009 | Lewis et al. | |
| 2009/0200337 | A1 | 8/2009 | Quinlan et al. | |
| 2009/0200338 | A1 | 8/2009 | Quinlan et al. | |
| 2009/0200339 | A1 | 8/2009 | Quinlan et al. | |
| 2009/0236370 | A1* | 9/2009 | Ray | 222/190 |
| 2009/0294477 | A1 | 12/2009 | Ciavarella et al. | |
| 2010/0051642 | A1* | 3/2010 | Wong et al. | 222/52 |
| 2010/0133300 | A1 | 6/2010 | van der Heijden et al. | |
| 2010/0200615 | A1 | 8/2010 | Ciavarella | |

* cited by examiner

AIR-ACTIVATED SEQUENCED VALVE SPLIT FOAM PUMP

TECHNICAL FIELD

The present invention relates generally to foam dispenser systems and more particularly to an air-activated, sequenced valve split foam pump, as well as a disposable refill/replacement unit for such a foam pump.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles.

SUMMARY

Foam dispenser systems and pumps for use in foam dispenser systems are disclosed herein. In one embodiment, a refill unit for refilling a foam dispenser system comprises a container for holding a supply of foamable liquid and a pump housing connected to the container. The pump housing comprises one or more connections for connecting to one or more external air pumps, wherein the air pumps supply air pressure to move the foamable liquid into a mixing chamber and to mix air with the liquid in the mixing chamber to create a foamable air-liquid mixture.

In this way, a simple and economical foam dispenser system, as well as a refill unit, are provided.

BRIEF DESCRIPTION OF THE DRAWINGS

These and other features and advantages of the present invention will become better understood with regard to the following description and accompanying drawings in which.

DETAILED DESCRIPTION

Figure 1:
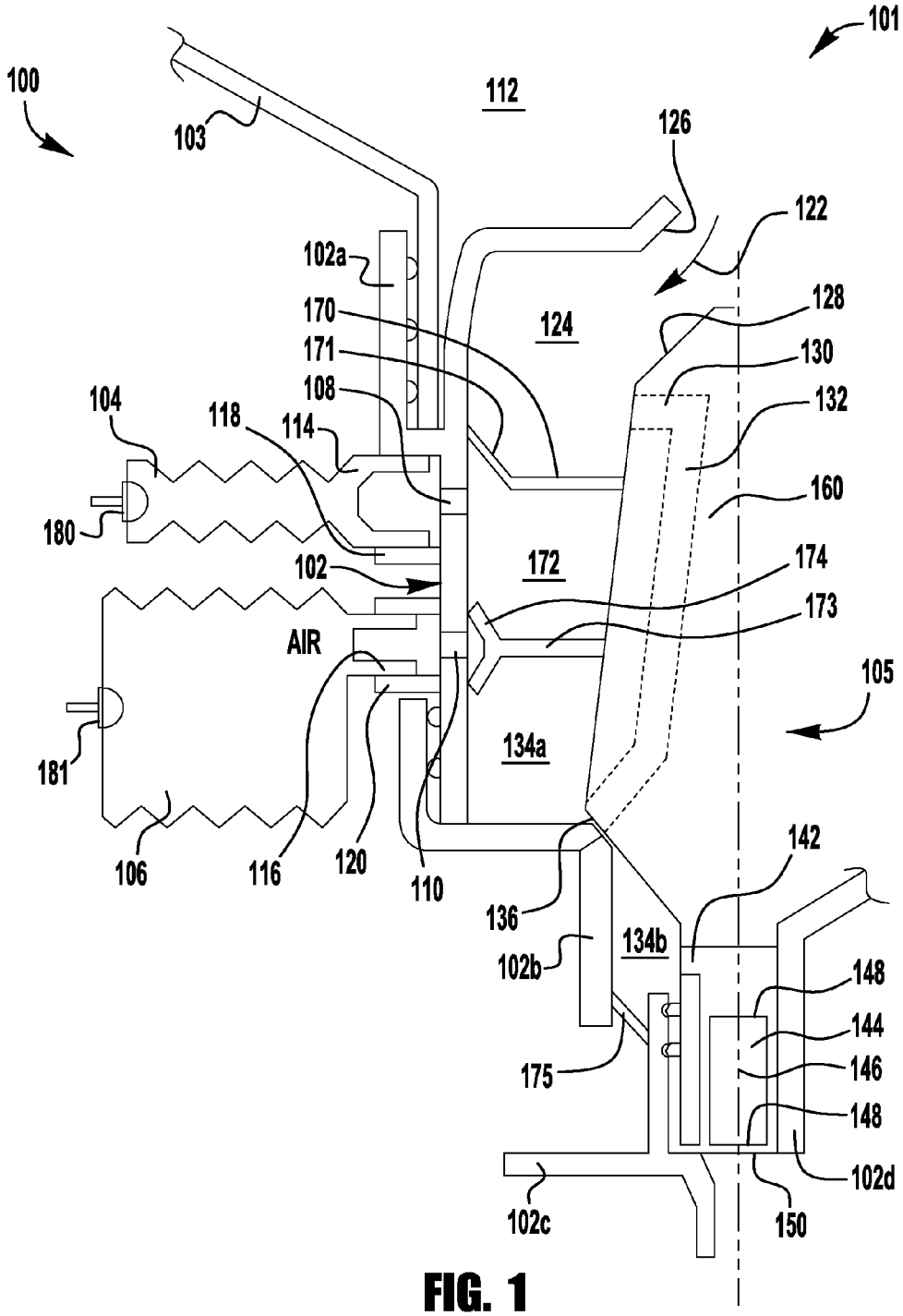
FIG. 1 is a cross-sectional illustration of a first exemplary embodiment of a foam pump 100, in a priming or primed state.
Figure 2:
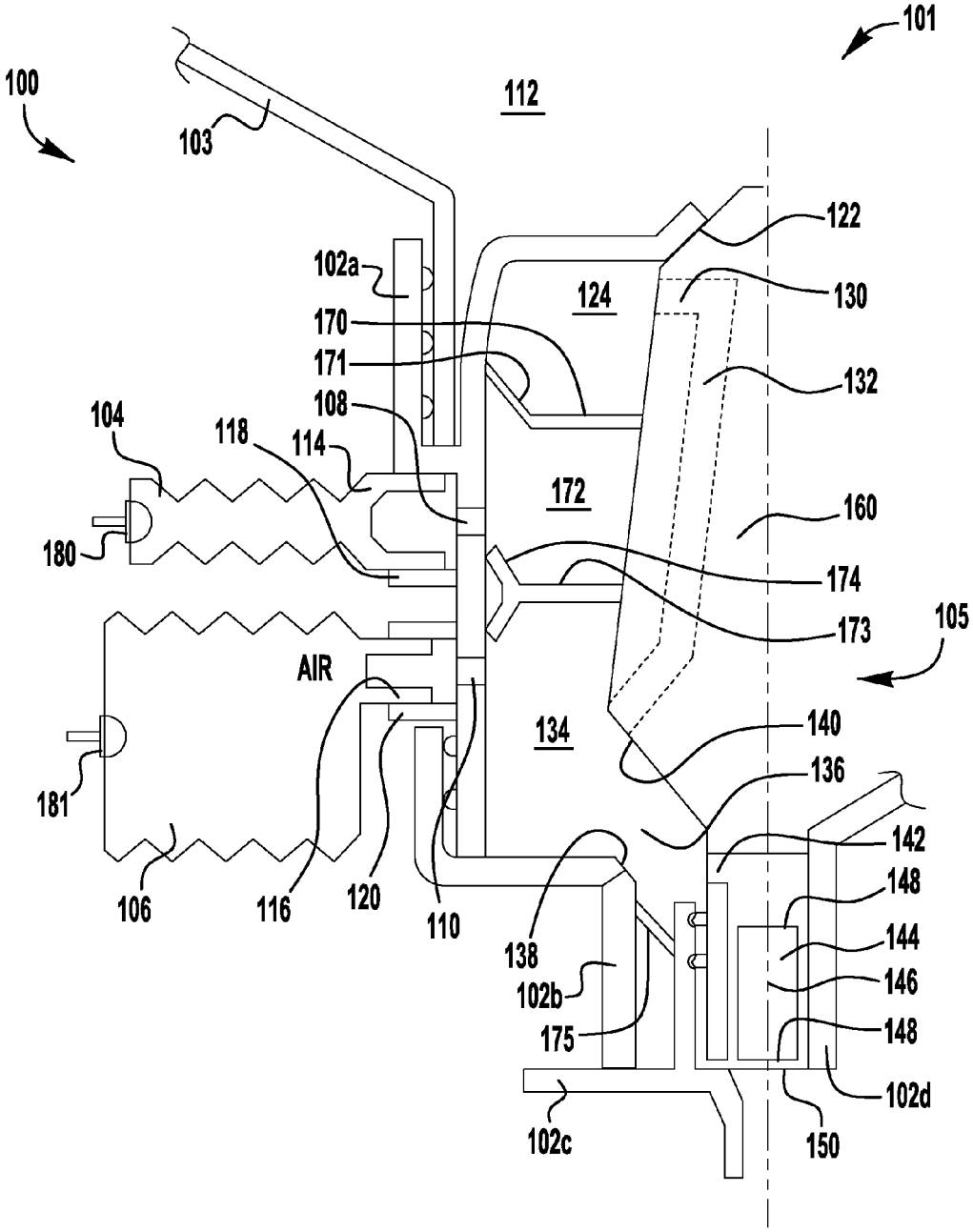
FIG. 2 is a cross-sectional illustration of the foam pump 100 of FIG. 1, in an actuating or unprimed state.

FIGS. 1-2 illustrate a first exemplary embodiment of a dispensing system 100 including a foam pump 105. Dispensing system 100 includes a housing (not shown) which also contains one or more actuating members (not shown) to activate the air pump 104 and air pump 106. In addition, the housing contains an actuator (not shown) to move valve member 160 up and down. FIG. 1 shows the foam pump 105 in a priming or primed state. FIG. 2 shows the foam pump 105 in a state ready to be actuated, actuating or unprimed state.

A refill unit 101 includes container 103 and foam pump 100. Disposable refill unit 101 is shown releasably connected to a first air pump 104 and a second air pump 106. In the exemplary foam pump 100, the air pumps 104, 106 are both bellows pumps. In other embodiments, the air pumps 104, 106 may have different means of providing pressurized air to the disposable refill unit 101, such as for example a piston pump or a dome pump. The first air pump 104 has at least one "blow" position, in which it provides pressurized air to push liquid through the disposable refill unit 101. The second air pump 106 also has at least one "blow" position, in which it provides pressurized air to mix with the moving liquid in the disposable refill unit 101 to form a foam.

In some embodiments, one or both of the air pumps 104, 106 may be in a constant "blow" state. Such a state may be useful if deadheading the pump is desirable or if a relief valve (not shown) is used. Additionally, such a state may be used in a high throughput area, or where a continuous source of pressurized air is available, such as a manufacturing plant. In other embodiments, one or both of the air pumps 104, 106 may have additional states. For example, one or both of the air pumps 104, 106 may also have an "off" state, in which no pressurized air is being delivered by the air pump. In the event multiple-state air pumps 104, 106 are employed, the state of the first air pump 104 may be independently operable from the state of the second air pump 106. Alternatively, in other embodiments, the two air pumps 104, 106 may be switched between their respective states only in conjunction with each other. In addition, the sizes of air pump 104 may be varied to, for example, move a larger quantity of liquid through foam pump 100.

The disposable refill unit 101 includes foam pump 105 that has a pump housing 102 composed of several interlocking housing members such as 102*a*, 102*b*, 102*c* and 102*d* connected to container 103. One of the housing members 102*a* of the disposable refill unit 101 has a liquid pump air inlet 108 connected to the first air pump 104, and a foaming air inlet 110 connected to the second air pump 106. In addition, housing member 102*a* has a threaded portion for connecting foam pump 105 to container 103.

Container 103 of disposable refill unit 101 forms a liquid reservoir 112. The liquid reservoir 112 contains a supply of a foamable liquid within the disposable refill unit 101. In various embodiments, the contained liquid could be for example a soap, a sanitizer, a cleanser, a disinfectant or some other foamable liquid. In the exemplary foam pump 100, the liquid reservoir 112 is formed by a rigid housing member 102*b*. In other embodiments, the liquid reservoir 112 may be formed by a collapsible container, a flexible bag-like container, or have any other suitable configuration for containing the foamable liquid without leaking. The container forming the liquid reservoir 112 within the disposable refill unit 101 may advantageously be refillable, replaceable or both refillable and replaceable. In other embodiments the liquid container within the disposable refill unit 101 may be neither refillable nor replaceable. A mechanical locking mechanism (not shown) may be provided to lock or hold a replaceable liquid container in place within the disposable refill unit 101.

The air pumps 104, 106 are disposed within an outer housing (not shown) of a foam dispenser system which includes the foam pump 100. The foam dispenser system may be a wall-mounted system, a counter-mounted system, an un-mounted portable system movable from place to place, or any other kind of foam dispenser system. The air pumps 104, 106 have respective releasable fittings 114, 116 which are removably received within mating fittings 118, 120 on the disposable refill unit 101 in a substantially airtight manner. In one embodiment, the releasable fittings 114, 116 are connected to mating fittings 118, 120 with a press-fit connection. Optionally, a mechanical mechanism (not shown) may be used to mechanically releasably secure the air pump 104 and air pump 106 to the pump housing 102 of refill unit 101. In that way, in the event the liquid stored in the reservoir 112 of the installed disposable refill unit 101 runs out, or the installed disposable refill unit 101 otherwise has a failure, the installed disposable refill unit 101 may be removed from the foam dispenser system. The empty or failed disposable refill unit 101 may then be replaced with a new disposable refill unit 101 including a liquid-filled reservoir 112. The air pumps 104, 106 with their fittings 114, 116 remain located within the foam dispenser system 100 while the disposable refill unit 101 is replaced. In one embodiment, air pumps 104, 106 are removable from the housing and removable from the refill unit 101 so that they may be replaced without replacing the dispenser, or alternatively to facilitate their removal and connection to the refill unit 101. The air pumps 104 and 106 are isolated from the portions of the foam pump 105 housing portions that contact liquid. In other words, the air pumps 104, 106 are sanitarily sealed from contact with liquid during operation of foam pump 105.

A liquid inlet gate valve 122 is disposed between the liquid reservoir 112 and a liquid charge chamber 124 within the disposable refill unit 101. The liquid inlet gate valve 122 is comprised of a first valve surface 126 formed by the pump housing member 102*a* and a second opposing valve surface 128 disposed on a movable valve member 160. The liquid inlet gate valve 122 closes and opens as the valve member 160 moves up and down, as described further below. FIG. 1 illustrates the valve 122 in an open position, while the pump 105 is in a priming or primed state. FIG. 2 illustrates the valve 122 in a closed position, while the pump 105 is in an actuating or unprimed state.

The liquid charge chamber 124 is disposed underneath the liquid reservoir 112 so that, if the liquid inlet gate valve 122 is open as shown in FIG. 1, liquid stored in the liquid reservoir 112 is gravity-fed down into the liquid charge chamber 124. The floor of the liquid charge chamber 124 is defined by a single wiper seal 170 which is attached to the valve member 160. As the valve member 160 moves up and down, the single prong distal end portion 171 of the wiper seal 170 slides up and down the interior surface of the housing member 102*a* in a liquid-tight manner. In that way, liquid stored in the liquid charge chamber 124 is prevented from escaping past the seal 170.

In one embodiment, liquid charging chamber 124 always receives a full shot of liquid; however, air pump 104 may be used to vary, or tune, the amount of liquid dispensed from the foam dispenser by varying the quantity of air that is used to force the liquid out of liquid charging chamber 124. Valve member 160 is moved up and down by an actuator (not shown) connected to the housing (not shown). In addition, the size of air pump 106 may be varied, or the stroke may be varied to adjust or tune the foam.

When the first air pump 104 is in its "blow" state, it delivers pressurized air to the liquid pump air inlet 108 of the disposable refill unit 101. The pressurized air enters an intermediate air chamber 172 disposed underneath the single wiper seal 170 and above a double wiper seal 173. The double wiper seal 173 is attached to the valve member 160, and has a distal end portion 174 which slides up and down the interior surface of the housing member 102*a* in an airtight manner. In that way, air is prevented from escaping the intermediate air chamber 172 past the seal 173. The delivered air pressure from the first air pump 104 is sufficient to overcome the single wiper seal 170, but not the double wiper seal 173. That is, the air pressure is high enough to overcome the downward force of gravity exerted on the distal end portion 171 of the single wiper seal 170 by the liquid stored in the liquid charge chamber 124, and the resiliency of wiper seal 170, thereby separating the distal end portion 171 from the housing member 102*a*. Conversely, the air pressure is not high enough to overcome the interference between the double wiper seal 173 and the housing member 102*a*. The pressurized air thus escapes from the intermediate air chamber 172 up into the liquid charge chamber 124, around the single prong distal end portion 171 of the single wiper seal 170. That same upward air pressure prevents liquid in the liquid charge chamber 124 from escaping down into the intermediate air chamber 172 past the seal 170, as the air travels upwardly around the seal 170.

In one embodiment, air pumps 104, 106 include one-way air inlet check valves 180, 181 respectively. One-way air inlet check valves 180, 181 allow air to enter into the air pumps 104, 106 to recharge the air pumps 104, 106.

When the pressurized air enters the liquid charge chamber 124, some of the liquid stored therein is forced into an inlet 130 of a liquid delivery conduit 132 formed in the valve member 160. That liquid flows down the conduit 132 to enter a mixing chamber 134 disposed underneath the double wiper seal 173. Although not shown in the Figures, the single wiper seal 170 may be attached to the valve member 160 directly adjacent to the inlet 130 in order to minimize the amount of liquid left in the liquid charge chamber 124.

In some cases, the embodiment of FIGS. 1-2 may not have any one-way check valves in the liquid delivery path from the liquid reservoir 112 to the mixing chamber 134 and even to the foam outlet 150. In other cases, the liquid delivery conduit 132 may contain a one-way check valve (not shown) to allow liquid and/or air to flow only one way through the conduit 132, from the liquid charge chamber 124 into the mixing chamber 134. Such a one-way check valve may be, for example, a flapper valve, a conical valve, a plug valve, an umbrella valve, a duck-bill valve, a ball valve, a slit valve, a mushroom valve, or any other one-way check valve.

A liquid outlet gate valve 136 is disposed between the liquid delivery conduit 132 and the mixing chamber 134 within the disposable refill unit 101. The liquid outlet gate valve 136 is comprised of a first valve surface 138 formed by the pump housing member 102*c*, and a second opposing valve surface 140 disposed on the movable valve member 160. The liquid outlet gate valve 136 opens and closes as the valve member 160 moves up and down, as described further below. FIG. 1 illustrates the valve 136 in a closed position, while the pump 105 is in a priming or primed state. The closing of the outlet gate valve 136 divides the mixing chamber 134 into two portions 134*a* and 134*b*. FIG. 2 illustrates the valve 136 in an open position, while the pump 105 is in an actuating or unprimed state. Gate valve 136 prevents liquid from flowing into the mixing chamber 134 while the foam pump 105 is in its recharging position (FIG. 1).

When the second air pump 106 is turned "on," it delivers pressurized air to the foaming air inlet 110 of the disposable refill unit 101. In the priming state of FIG. 1, the inlet 110 is blocked by the double wiper seal 173. That is, the distal end portion 174 completely surrounds the inlet 110 on all sides to seal it off. Preferably, air pump 106 is not turned on in this state. When the second air pump 106 is turned "on" in the actuating state of FIG. 2, the foaming air inlet 110 is unblocked and leads directly to the mixing chamber 134.

When the wiper seal is in the position shown in FIG. 2, the air pressure delivered through the foaming air inlet 110 is not high enough to overcome the interference between the double wiper seal 173 and the housing member 102*a*. Therefore, the pressurized air entering the mixing chamber 134 from the foaming inlet 110 is prevented from passing into the intermediate air chamber 172 by the double wiper seal 173. Instead, the pressurized air moves downwardly into the mixing chamber 134, to mix with the liquid arriving in the mixing chamber 134 through the liquid delivery conduit 132. That same incoming air pressure prevents liquid and foam in the mixing chamber 134 from escaping through the air inlet 110.

In the mixing chamber 134, the foamable liquid arriving from the liquid delivery conduit 132 and the pressurized air arriving from the foaming air inlet 110 mix together in a swirling motion to form a mixture. A wiper seal 175 is attached to the housing member 102*c*, which moves up and down with the valve member 160. As the valve member 160 and the housing member 102*c* move up and down, the distal end of the wiper seal 175 slides up and down the interior surface of the housing member 102*b* in a liquid, air and/or foam tight manner. In that way, liquid, air and foam are prevented from escaping the mixing chamber 134 past the seal 175. Thus, the liquid-air mixture within the mixing chamber 134 is forced by gravity and the incoming pressure at the liquid delivery conduit 132 and the air inlet 110 into an inlet 142 of a foaming chamber 144.

Within the foaming chamber 144, the liquid-air mixture is enhanced into a rich foam. For example, the foaming chamber 144 may house one or more foaming elements therein. Suitable foaming elements include, for example, one or more screens, mesh, porous membranes, or sponges. In addition, one or more of such foaming element(s) may be disposed in a foaming cartridge within the foaming chamber 144. The foam pump 105, for example, has a foaming cartridge 146 with two screen foaming elements 148. As the liquid/air mixture passes through the foaming element(s), the mixture is turned into an enhanced foam. In some embodiments, the mixing and foaming action may both occur in one single chamber, which is then both a mixing chamber and a foaming chamber. The foam is dispensed from the foaming chamber 144 through a foam outlet 150.

In some embodiments, the foam outlet 150 is simply a channel or aperture leading from the foaming chamber 144 to the outside atmosphere surrounding the foam dispenser system. In other embodiments, the foam outlet 150 may include one or more one-way check valves (not shown) to prevent back flow of foam from the foam outlet 150 into the foaming chamber 144 or to prevent unwanted discharge while the dispenser is not being used. Such one-way check valves may be, for example, any of the types identified above in relation to the liquid delivery conduit 132.

In a preferred embodiment, the air to liquid ratio in the mixture formed in the mixing chamber 134 is approximately 10:1, but any ratio may be provided. The air to liquid ratio is determined by the volume and pressure of the air being delivered by the first and second air pumps 104, 106 and the amount of liquid entering the mixing chamber 134 from the liquid delivery conduit 132. Thus, the first air pump 104 is schematically illustrated in FIGS. 1 and 2 as being a much smaller volume bellows pump than the second air pump 106. Once these and other applicable design variables are chosen to provide the desired air to liquid ratio, a consistently accurate dosing is thereafter provided.

The foam pump 105 operates in the following manner. Although not shown in FIGS. 1 and 2, the foam dispenser system 100 in which the foam pump 105 is situated has a pump actuator mechanism. As will be appreciated by one of ordinary skill in the art, there are many different kinds of pump actuators which may be employed in the foam dispenser system 100. The pump actuator of the foam dispenser system 100 may be any type of actuator, such as, for example, a manual lever, a manual pull bar, a manual push bar, a manual rotatable crank, an electrically activated actuator, or other means for actuating the foam pump 105 within the foam dispenser system 100. Electronic pump actuators may additionally include a motion detector to provide for a hands-free dispenser system with touchless operation. Various intermediate linkages connect an external actuator member to the first air pump 104, the second air pump 106, and the valve member 160 to operate the foam pump 105.

In one embodiment, one or more additional valves (not shown) may be used to prevent a constant flow of liquid if the pump is held in an intermediate state whereby valves 122 and 136 are open at the same time. The valves may be one or more one-way valves, check valves, spring and ball valves, duck bill valves or other another valve with a minimum set cracking pressure. The valves may be located at the top of inlet 130, 142.

FIG. 1 illustrates the foam pump 105 in a priming or primed state, that is, before actuation. In that condition, the pump actuator holds the valve member 160 in the downward position illustrated in FIG. 1. The first and second air pumps 104, 106 are turned "off" so that they are not supplying pressurized air in the priming or primed state of FIG. 1. In the priming or primed state of FIG. 1, the liquid inlet gate valve 122 is open, so that liquid stored in the liquid reservoir 112 is gravity-fed down into the liquid charge chamber 124. Some of the liquid may additionally continue down into the liquid delivery conduit 132. However, the liquid outlet gate valve 136 at the bottom of the liquid delivery conduit 132 is closed, so liquid is prevented from exiting that conduit 132. Thus, if the liquid delivery conduit 132 is wide enough to permit air to pass upwardly into the liquid charge chamber 124 and then into the liquid reservoir 112 as liquid flows into the conduit 132, then the entering liquid may entirely fill the liquid delivery conduit 132. If the liquid delivery conduit is not so wide, though, the entering liquid will instead form a bubble of air in the liquid delivery conduit 132 underneath the liquid, preventing the liquid from entirely filling the conduit 132.

FIG. 2 illustrates the foam pump 100 upon actuation, that is, in its pumping state. In that condition, the pump actuator holds the valve member 160 in an upward position. The first and second air pumps 104, 106 are turned "on" so that they are supplying pressurized air. Air pumps 104, 106 may be turned "on" by, for example, compressing them as would be done with the illustrated bellows air pump or in one embodiment, may be an electrically operated pump and turned on by energizing the pump. The liquid inlet gate valve 122 is closed, preventing liquid from exiting the liquid reservoir 112 into the liquid charge chamber 124. The closing of the liquid inlet gate valve 122 also prevents pressurized air supplied by the first air pump 104 from passing up into the liquid reservoir 112. The liquid outlet gate valve 136, however, is open. In this way, the pressurized air supplied by the first air pump 104 pushes the liquid held in the liquid charge chamber 124 and/or the liquid delivery conduit 132 down the conduit 132 and into the mixing chamber 134. And, as already described above, the pressurized air from the second air pump 106 mixes with the liquid in the mixing chamber 134 and the foaming chamber 144 to form a foam. The foam is pushed out of the disposable refill unit 101 through the foam outlet 150.

The pump actuator then repositions the valve member 160 in the lower, priming position of FIG. 1. Thus, liquid is once again free to travel downwardly from the liquid reservoir 112 into the liquid charge chamber 124. Once the chamber 124 is full of liquid, the pump 100 is primed and ready for another pumping actuation.

During operation of the foam pump 105, the first and second air pumps 104, 106 and the intermediate air chamber 172 preferably remain dry or free from liquids and foamy mixtures, to prevent bacteria from growing in those areas. This is accomplished by the single wiper seal 170, the double wiper seal 173, and the incoming air pressure from the pumps 104, 106. The seals 170, 173 are sanitary seals in that they prevent liquid and foam from contaminating the pumps 104, 106 or coming into contact with elements of the foam dispenser system that are located outside of the intended liquid and foam delivery path. Optionally, additional one-way valves may be added to inlets 108 and 110 to further ensure that liquid does not contaminate air pumps 104, 106.

Figure 3:
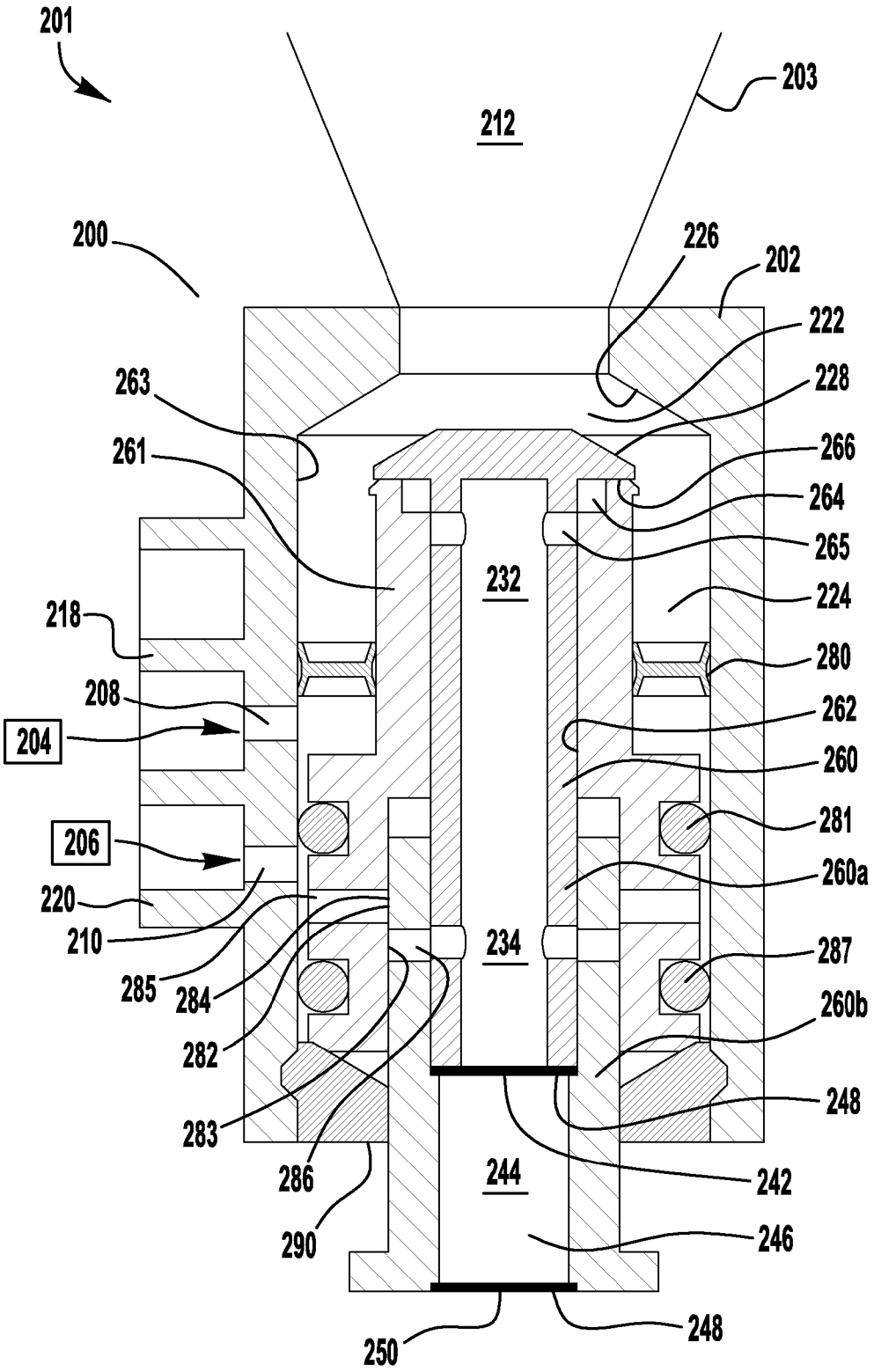
FIG. 3 is a cross-sectional illustration of a second exemplary embodiment of a foam pump 200, in a priming or primed state.
Figure 4:
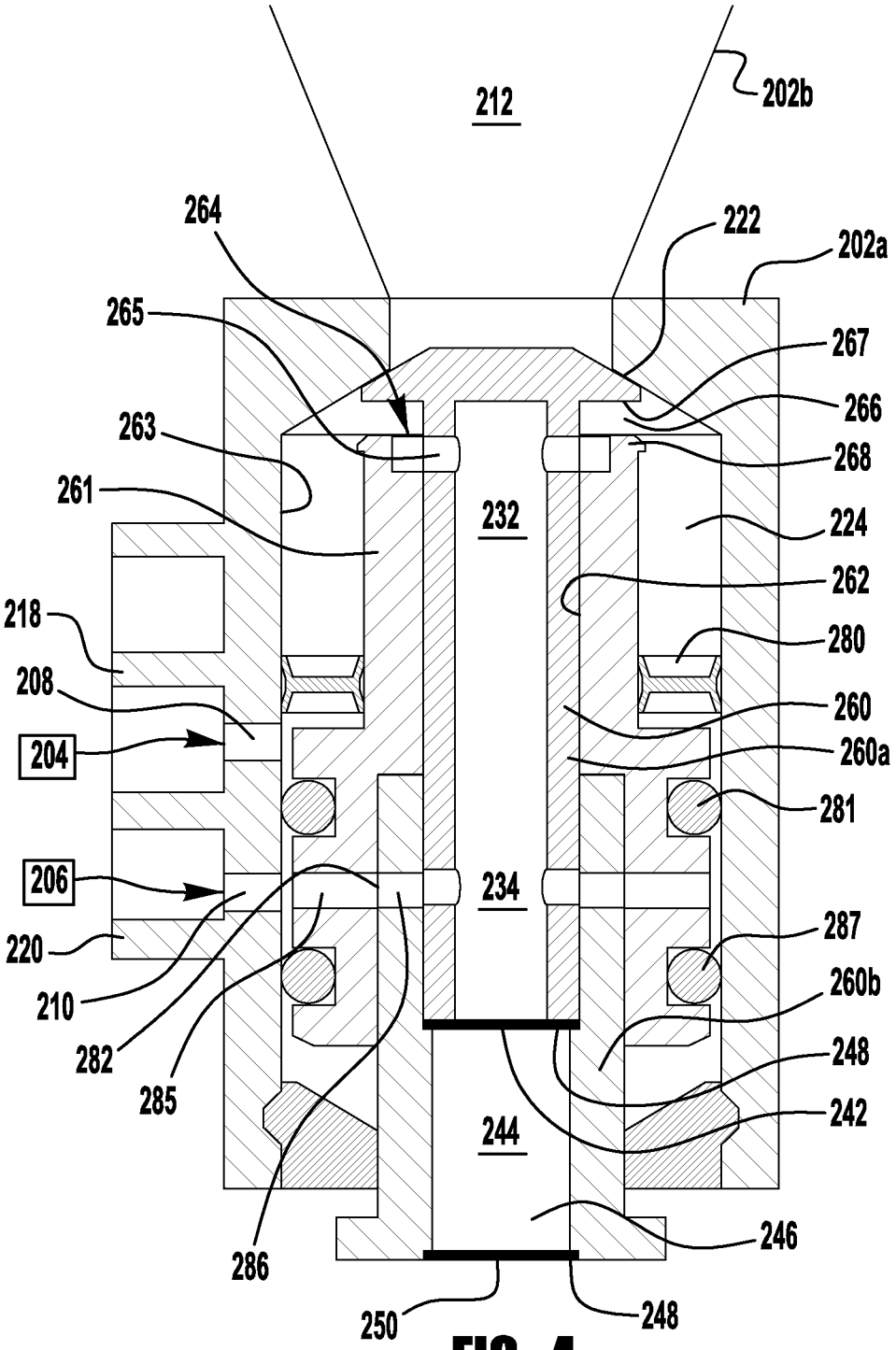
FIG. 4 is a cross-sectional illustration of the foam pump 200 of FIG. 3, in an actuating or unprimed state, and with a liquid piston 280 in a lower position.
Figure 5:
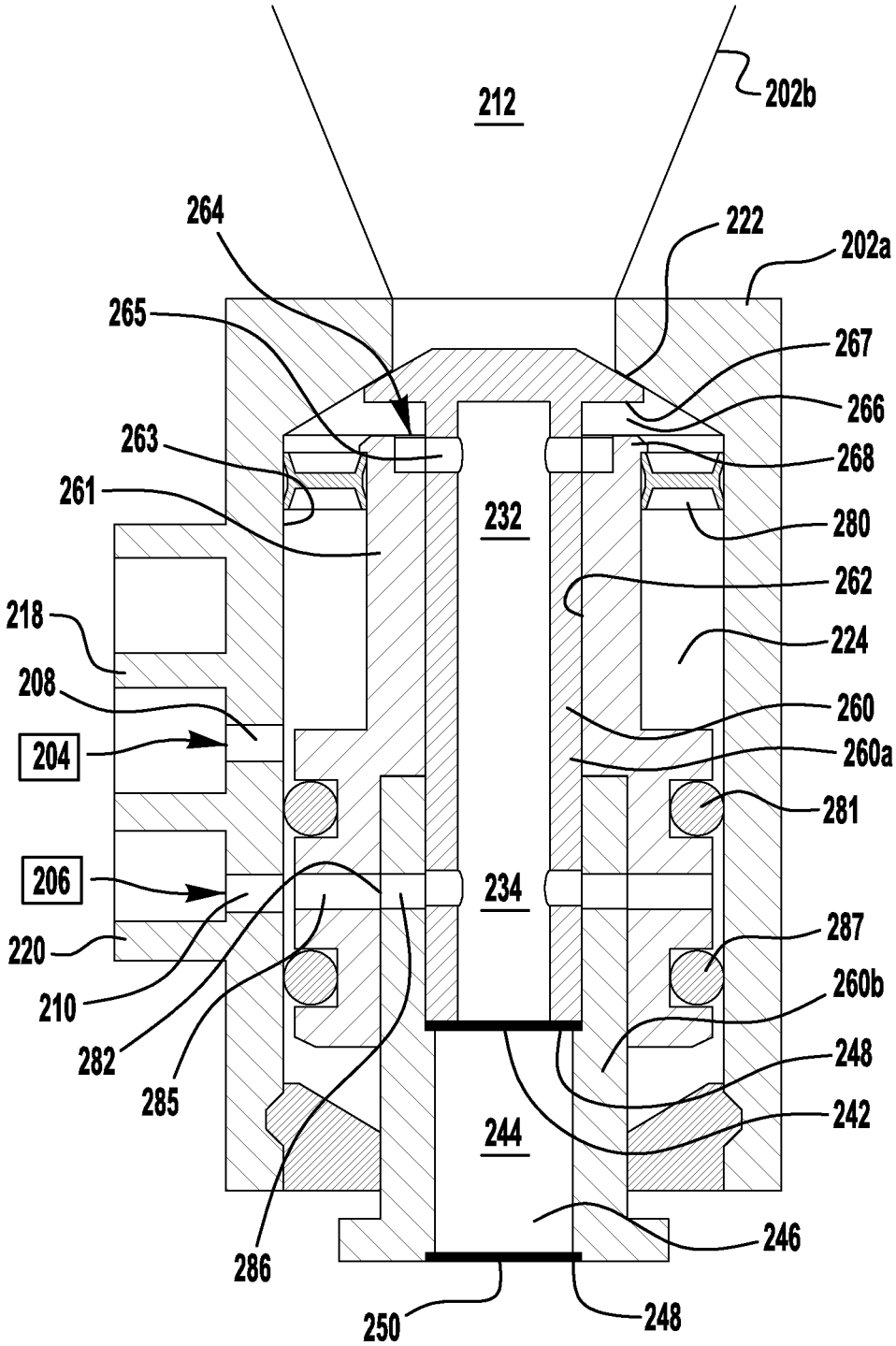
FIG. 5 is a cross-sectional illustration of the foam pump 200 of FIG. 3, in an actuating or unprimed state, and with a liquid piston 280 in an upper position.

FIGS. 3-5 illustrate a second exemplary embodiment of a refill unit 201 including a foam pump 200 and container 203 for a foam dispenser system (not shown). FIG. 3 shows the foam pump 200 in a priming or primed state. FIGS. 4 and 5 show the foam pump 200 in an actuating or unprimed state.

Disposable refill unit 201 includes foam pump 200. Foam pump 200 includes connection ports for connecting to a first air pump 204 and a second air pump 206. In the exemplary foam dispensing system, the air pumps 204, 206 are illustrated as blocks, which may both be bellows pumps as shown in FIGS. 1 and 2. In other embodiments, the air pumps 204, 206 may have different means of providing pressurized air to the disposable refill unit 201, such as for example a piston pump or a dome pump. The first air pump 204 has at least one "blow" condition, in which it provides pressurized air to move a liquid piston 280 upwardly and thereby push liquid through the disposable refill unit 201. The first air pump 204 additionally has at least one "vacuum" condition, in which it provides a vacuum suction force to remove air from the housing of the foam pump 200 and thereby move the liquid piston 280 downwardly. Optionally, a biasing member (not shown) may be used to move piston 280 downwardly, and in that case, first air pump 204 may include a one-way air inlet valve to allow air in to recharge the first air pump 204. The second air pump 206 also has at least one "blow" position, in which it provides pressurized air to mix with the moving liquid in the disposable refill unit 201 to form a foam. Second air pump 206 may include a one-way air inlet valve to allow air in to recharge the second air pump 206. In one embodiment, second air pump 206 draws air back through outlet 250 to recharge second air pump 206 with air.

One or both of the air pumps 204, 206 may also have an "off" state, in which no pressurized air and no vacuum suction force is being delivered by the air pump. In the event multiple-state air pumps 204, 206 are employed, the state of the first air pump 204 may be independently operable from the state of the second air pump 206. For example, first air pump 204 may be activated to push liquid into mixing chamber 232 prior to activating the second air pump 206 so that upon activation of second air pump 206 liquid is already in the mixing chamber and the air is forced to mix with the liquid prior to exiting foam pump 200. Alternatively, in other embodiments, the two air pumps 204, 206 may be switched between their respective states only in conjunction with each other.

The foam pump 200 has a pump housing 202. Pump housing 202 of the disposable refill unit 201 has a liquid pump air inlet 208 connectable to the first air pump 204 and a foaming air inlet 210 connectable to the second air pump 206.

Disposable refill unit 201 also includes container 203 which forms a liquid reservoir 212. The liquid reservoir 212 contains a supply of a foamable liquid within the disposable refill unit 201. In various embodiments, the contained liquid could be for example a soap, a sanitizer, a cleanser, a disinfectant, or some other foamable liquid. Preferably, the liquid reservoir 212 is be formed by a collapsible container. Optionally, liquid reservoir 212 is a flexible bag-like container, or any other suitable configuration for containing the foamable liquid without leaking. In one embodiment, liquid reservoir 212 is formed by a rigid housing member. In such a case, the rigid housing member may contain an air inlet valve to allow air to enter the container to prevent a vacuum from preventing the foamable liquid from flowing out of the container. The container forming the liquid reservoir 212 within the disposable refill unit 201 is preferably replaceable; however, it may advantageously be refillable, or both refillable and replaceable. In other embodiments, the liquid container within the disposable refill unit 201 may be neither refillable nor replaceable. A mechanical locking mechanism (not shown) may be provided to lock or hold a replaceable liquid container in place within the disposable refill unit 201. The refill unit 201 is replaceable without replacing the air pumps 204, 206 and is replaceable without dismantling the foam pump 200 which remains connected to the container 203, while air pumps preferably remain connected to a dispenser housing and are reused upon replacement of refill unit 201.

The air pumps 204, 206 are disposed within an outer housing (not shown) of a foam dispenser system which includes the foam pump 200. The foam dispenser system may be a wall-mounted system, a counter-mounted system, an un-mounted portable system movable from place to place, or any other kind of foam dispenser system. The air pumps 204, 206 have respective fittings (not shown) which are removably received within mating fittings 218, 220 on the disposable refill unit 201 in a substantially airtight manner. In that way, in the event the liquid stored in the reservoir 212 of the installed disposable refill unit 201 runs out, or the installed disposable refill unit 201 otherwise has a failure, the installed disposable refill unit 201 may be removed from the foam dispenser system without removing the air pumps 204, 206. The empty or failed disposable refill unit 201 may then be replaced with a new disposable refill unit 201 including a liquid-filled reservoir 212. The air pumps 204, 206 remain located within the foam dispenser system while the disposable refill unit 201 is replaced.

The foam pump 200 has an inner movable valve member 260 and an outer movable valve member 261. The inner valve member 260 is movably received within a central channel 262 of the outer valve member 261, allowing the inner valve member 260 to move up and down within the outer valve member 261. In the particular embodiment of FIGS. 3-5, the inner valve member 260 includes a first portion **260*a* and a second portion 260*b* which are fixed to each other. Other embodiments may have a unitary inner valve member 260. The outer valve member 261 may move up and down within a central bore 263 of the housing member 202**.

A liquid inlet 264 at the top of the outer valve member 261 is in the shape of an annular counterbore surrounding the channel 262. The inner valve member 260 also has a liquid inlet 265, in the form of one or more holes disposed around the periphery of the inner valve member 260 near its upper end. In the particular embodiment of FIGS. 3-5, there are two such inlets 265.

FIG. 3 shows the inner and outer valve members 260, 261 of the pump 200, each in a downward position, corresponding to a priming or primed state. In that position, an outer liquid inlet gate valve 222 is disposed between the liquid reservoir 212 and a liquid charge chamber 224 within pump housing 202. The outer liquid inlet gate valve 222 is comprised of a first valve surface or valve seat 226 formed by the pump housing member 202*a* and a second opposing valve surface or valve head 228 disposed on the inner valve member 260. The outer liquid inlet gate valve 222 closes and opens as the inner valve member 260 moves up and down, as described further below.

The liquid charge chamber 224 is disposed underneath the liquid reservoir 212 so that, if the outer liquid inlet gate valve 222 is open as shown in FIG. 3, liquid stored in the liquid reservoir 212 is gravity-fed down into the liquid charge chamber 224. Optionally, liquid is drawn into charging chamber 224 by a vacuum created by moving liquid piston 280 downward. The floor of the liquid charge chamber 224 is defined by an annular liquid piston 280 which moves up and down within the liquid charge chamber 224. As the liquid piston 280 moves up and down, its outer edge slides up and down the interior surface of the housing member 202 in a liquid-tight and airtight manner. And, the inner edge of the piston 280 slides up and down the outer surface of the outer valve member 261 in a liquid-tight and airtight manner. In that way, liquid stored in the liquid charge chamber 224 is prevented from passing downwardly past the piston 280, and pressurized air delivered by the first air pump 104 is prevented from passing upwardly past the piston 280. Moreover, an upper o-ring seal 281 disposed within the outer surface of the outer valve member 261 slidingly contacts the surface of the central bore 263 of the housing member 202*a* in an airtight manner. In that way, pressurized air delivered by the first air pump 204 is prevented from passing downwardly past the upper o-ring seal 281.

Further describing the priming or primed condition of FIG. 3, the liquid inlet 264 of the outer valve member 261 and the liquid inlet 265 of the inner valve member 260 are closed off by an inner liquid inlet gate valve 266. The inner liquid inlet gate valve 266 is comprised of a first valve surface 267 formed by the inner valve member 260, and a second opposing valve surface 268 disposed on the outer valve member 261. More particularly, the downward positioning of the inner valve member 260 within the outer valve member 261 causes the two surfaces 267, 268 to contact each other and prevent the flow of liquid through the inner valve 266. Thus, liquid remains trapped within the liquid charge chamber 224 in the priming or primed state of FIG. 3. Outer valve member 261 is retained within foam pump housing 202 by annular retaining ring 290.

Still describing the priming or primed condition of FIG. 3, the foaming air inlet 210 is closed off by an air valve 282 formed between the inner valve member 260 and the outer valve member 261. The air valve 282 is comprised of a first valve surface 283 formed by the inner valve member 260, and a second opposing valve surface 284 disposed on the outer valve member 261. Air valve 282 need not be airtight, as during normal operation air pump 206 is not pumping air during the priming or charging condition. As the inner valve member 260 moves up and down within the central channel 262 of the outer valve member 261, their air inlets 285, 286 come in and out of alignment with each other. The downward positioning of the inner valve member 260 within the outer valve member 261 causes the two surfaces 267, 268 to contact each other and prevent the flow of liquid through the inner valve 266. Moreover, a lower o-ring seal 287 disposed within the outer surface of the outer valve member 261 slidingly contacts the surface of the central bore 263 of the housing member 202 in an airtight manner. In that way, pressurized air delivered by the second air pump 206 is prevented from passing downwardly past the lower o-ring seal 287.

The liquid charge in liquid charging chamber 224 may be adjusted or tuned by using the vacuum pressure of air pump 204 to move liquid piston 280 to a location that does not fully expand liquid charging chamber 224. Other methods of tuning pump 200 include varying the amount of air pumped by air pump 206.

In addition, in one embodiment, a valve (not shown), such as a check valve, a one-way valve or a valve with a minimum set cracking pressure, may be used to prevent liquid from continuously flowing through the housing if the piston is not fully moved into its uppermost or lowermost positions. Such a valve (not shown) may be located in, for example, mixing chamber 234 below air inlet 286.

FIGS. 4 and 5 show the valve members 260, 261 of the pump 200 in an upward position, corresponding to an actuating or unprimed state. In that position, the outer liquid inlet gate valve 222 is closed, as the first valve surface 226 is in contact with the second valve surface 228. With the outer inlet gate valve 222 in that closed condition, liquid stored in the liquid reservoir 212 is prevented from flowing down into the liquid charge chamber 224. Liquid which has already entered the liquid charge chamber 224 is prevented from escaping that chamber 224 by the closed outer liquid inlet gate valve 222 above and the liquid piston 280 below.

Further describing the actuating or unprimed condition of FIGS. 4 and 5, the inner liquid inlet gate valve 266 is open. More particularly, the upward positioning of the inner valve member 260 within the outer valve member 261 causes the two valve surfaces 267, 268 to separate from each other. In that position, the liquid inlet 264 of the outer valve member 261 and the liquid inlet 265 of the inner valve member 260 are both exposed, so that liquid within the liquid charge chamber 224 may exit the chamber through those inlets 264, 265.

Still describing the actuating or unprimed condition of FIGS. 4 and 5, the air valve 282 is open. The upward positioning of the inner valve member 260 within the outer valve member 261 causes apertures 285, 286 to align with each other, thus permitting pressurized air to pass from the foaming air inlet 210 through the air valve 282. As in the priming or primed condition, the lower o-ring seal 287 prevents pressurized air delivered by the second air pump 206 from passing downwardly past the lower o-ring seal 287.

When the first air pump 204 is set to its "blow" state in the actuating condition of FIGS. 4 and 5, it delivers pressurized air to the liquid pump air inlet 208 of the disposable refill unit 201. The pressurized air enters the liquid charge chamber 224 underneath the liquid piston 280 and above the upper o-ring seal 281. The delivered air pressure from the first air pump 204 is high enough to overcome the downward force of gravity exerted on the liquid piston 280 by the liquid stored in the liquid charge chamber 224. Conversely, the air pressure is not high enough to overcome the seal between the upper o-ring seal 281 and the inner wall of the housing member 202*a*. The pressurized air thus forces the liquid piston 280 to move upwardly within the chamber 224, from the lower position shown in FIG. 4 to the upper position shown in FIG. 5. In the actuating state shown by those figures, the inner liquid inlet gate valve 266 is open. So, as the liquid piston 280 moves upwardly, the liquid stored within the liquid charge chamber 224 is forced into the inlets 264, 265 to enter a liquid delivery conduit 232 formed in the inner valve member 260. That liquid flows down the conduit 232 to enter a mixing chamber 234 also formed in the inner valve member 260.

In some cases, the embodiment of FIGS. 3-5 may not have any one-way check valves in the entire liquid delivery path, from the liquid reservoir 212 to the mixing chamber 234 and even to the foam outlet 250. In other cases, the liquid delivery conduit 232 may contain a one-way check valve (not shown) to allow liquid and/or air to flow only one way through the conduit 232, from the liquid charge chamber 224 into the mixing chamber 234. Such a one-way check valve may be, for example, a flapper valve, a conical valve, a plug valve, an umbrella valve, a duck-bill valve, a ball valve, a slit valve, a mushroom valve or any other one-way check valve.

When the first air pump 204 is set to its "vacuum" state in the actuating condition of FIGS. 4 and 5, it provides a vacuum suction force to remove air from the disposable refill unit 201. That force in turn moves the liquid piston 280 downwardly within the liquid charge chamber 224, from the upper position shown in FIG. 5 to the lower position shown in FIG. 4.

When the second air pump 206 is set to its "blow" state in the actuating condition of FIGS. 4 and 5, it delivers pressurized air to the foaming air inlet 210 of the disposable refill unit 201. The delivered air pressure from the second air pump 206 is not high enough to overcome the seal between the upper o-ring seal 282 and the inner wall of the housing member 202*a*, or the seal between the lower o-ring seal 287 and the inner wall of the housing member 202*a*. Because the air valve 282 is open, the pressurized air thus flows directly to the mixing chamber 234 to mix with the liquid arriving in the mixing chamber 234 through the liquid delivery conduit 232. That same incoming air pressure prevents liquid and foam in the mixing chamber 234 from escaping through the air valve 282 and the foaming air inlet 210.

In the mixing chamber 234, the foamable liquid arriving from the liquid delivery conduit 232 and the pressurized air arriving from the open air valve 282 mix together in a swirling motion to form a mixture. Thus, the liquid-air mixture is forced into an inlet 242 of a foaming chamber 244, where the mixture is enhanced into a rich foam.

For example, the foaming chamber 244 may house one or more foaming elements therein. Suitable foaming elements include, for example, a screen, mesh, porous membrane, or sponge. Such foaming element(s) may be disposed in a foaming cartridge within the foaming chamber 244. As the liquid/air mixture passes through the foaming element(s), the mixture is turned into an enhanced foam. In some embodiments, the mixing and foaming action may both occur in one single chamber, which is then both a mixing chamber and a foaming chamber. The foam is dispensed from the foaming chamber 244 through a foam outlet 250.

In some embodiments, the foam outlet 250 is simply a channel or aperture leading from the foaming chamber 244 to the outside atmosphere surrounding the foam dispenser system. In other embodiments, the foam outlet 250 may include one-way check valves to prevent back flow of foam from the foam outlet 250 into the foaming chamber 244 or to prevent unwanted discharge while the dispenser is not being used. Such one-way check valves may be, for example, any of the types identified above in relation to the liquid delivery conduit 232.

In a preferred embodiment, the air to liquid ratio in the mixture formed in the mixing chamber 234 is approximately 10:1, but any ratio may be provided. The air to liquid ratio is determined by the volume and pressure of the air being delivered by the first and second air pumps 204, 206, and the amount of liquid entering the mixing chamber 234 from the liquid delivery conduit 232. Once these and other applicable design variables are chosen to provide the desired air to liquid ratio, a consistently accurate dosing is thereafter provided.

The foam pump 200 operates in the following manner. Although not shown in FIGS. 3-5, the foam dispenser system in which the foam pump 200 is situated has a pump actuator mechanism. As will be appreciated by one of ordinary skill in the art, there are many different kinds of pump actuators which may be employed in the foam dispenser system. The pump actuator of the foam dispenser system may be any type of actuator, such as, for example, a manual lever, a manual pull bar, a manual push bar, a manual rotatable crank, an electrically activated actuator, or other means for actuating the foam pump 200 within the foam dispenser system. Electronic pump actuators may additionally include a motion detector to provide for a hands-free dispenser system with touchless operation. Various intermediate linkages connect an external actuator member to the first air pump 204, the second air pump 206, and the valve members 260 and 261 to operate the foam pump 200.

FIG. 3 illustrates the foam pump 200 in a priming or primed state, that is, before actuation. In that condition, the pump actuator holds the inner valve member 260 and the outer valve member 261 in downward positions. The first and second air pumps 204, 206 may be turned "off" so that they are not supplying pressurized air. In an alternate embodiment, however, the first air pump 204 may be set to "vacuum" in order to hold the liquid piston 280 in the downward position of FIG. 3. And, in a yet further embodiment, the second air pump 206 may be left "on" in the priming or primed state of FIG. 3. In that event, pressurized air from the second air pump 206 is held back by the air valve 282, which is closed.

In the priming or primed state of FIG. 3, the outer liquid inlet gate valve 222 is open, so that liquid stored in the liquid reservoir 212 is gravity-fed down into the liquid charge chamber 224, or pulled in by a vacuum created by downward movement of piston 280. However, the inner liquid inlet gate valve 266 is closed, so that liquid is prevented from exiting the liquid charge chamber 224 through the liquid delivery conduit 232. Once the liquid charge chamber 224 is full of liquid, the pump 200 is fully primed and ready for an actuation.

FIGS. 4 and 5 illustrate the foam pump 200 upon actuation, that is, in its pumping state. In that condition, the pump actuator holds the inner valve member 260 and the outer valve member 261 in upward positions. The first and second air pumps 204, 206 are set to "on" so that they are supplying pressurized air. The outer liquid inlet gate valve 222 is closed, preventing liquid from exiting the liquid reservoir 212 into the liquid charge chamber 224. The closed position of the outer liquid inlet gate valve 222 also prevents pressurized air supplied by the first air pump 204 from passing up into the liquid reservoir 212. The inner liquid inlet gate valve 266, however, is open. In this way, the pressurized air supplied by the first air pump 204 pushes the liquid piston 280 upwardly within the liquid charge chamber 224. That movement pushes the liquid to pass through the inner liquid inlet gate valve 266, down the liquid delivery conduit 232 and into the mixing chamber 234. And, as already described above, the pressurized air from the second air pump 206 mixes with the liquid in the mixing chamber 234 and the foaming chamber 244 to form a foam. The foam is pushed out of the disposable refill unit 201 through the foam outlet 250 by the air pressure entering the foaming air inlet 210.

The pump actuator then sets the first air pump 204 to an "off" or a "vacuum" state, so that the air piston 280 moves downwardly within the liquid charge chamber 224. The pump actuator also positions the inner valve member 260 and the outer valve member 261 in the downward positions of FIG. 3. Thus, liquid is once again free to travel downwardly from the liquid reservoir 212 into the liquid charge chamber 224. Once the chamber 224 is full of liquid, the pump 200 is primed and ready for another pumping actuation.

During operation of the foam pump 200, the first and second air pumps 204, 206 and the air chamber underneath the liquid piston/seal 280 preferably remain dry or free from liquids and foamy mixtures, to prevent bacteria from growing in those areas. This is accomplished by the liquid piston/seal 280, the upper o-ring seal 281, and the incoming air pressure from the pumps 204, 206. The seals 280, 281 are sanitary seals in that they prevent liquid and foam from contaminating the pumps 204, 206 or coming into contact with elements of the foam dispenser system that are located outside of the intended liquid and foam delivery path. Optionally, additional one-way valves (not shown) may be inserted into inlets 218, 210 to ensure liquid does not pass through the openings and contaminate air pumps 204, 206.

In an alternative embodiment, the basic structure of the pump 200 may be used with the air valve 282 permanently open or otherwise not used. In one such embodiment, for example, the inner valve member 260 moves up and down to control the pump 200, while the outer valve member 261 remains stationary in its upper position shown in FIGS. 4 and 5.

Figure 6:
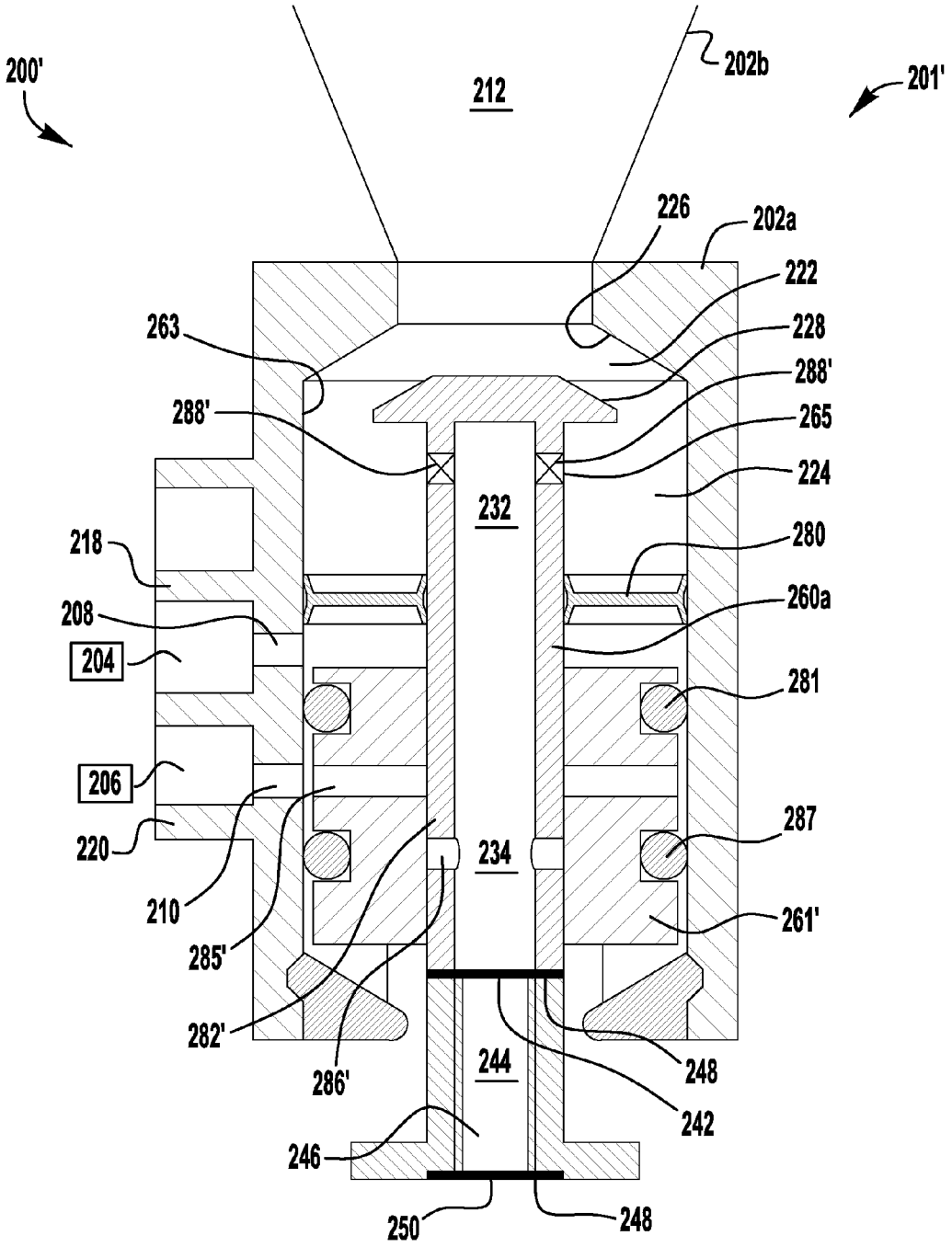
FIG. 6 is a cross-sectional illustration of a third embodiment of a foam pump 200', in a priming or primed state.

Yet another embodiment of a pump 200' is illustrated in FIG. 6, which is a modified version of the pump 200 shown in FIGS. 3-5. As such, identical components bear the same reference numerals, while modified components bear the same reference numeral with a prime symbol added. The modifications principally include a different inner valve member 260*a* and a different outer valve member 261'. The outer valve member 261' remains stationary during operation of the pump 200', so that the foaming air inlet 210 remains aligned with the inlet 285' of the outer valve member 261'. The o-ring seals 281, 287 keep the air pressure delivered by the second air pump 206 sealed from the air pressure delivered by the first air pump 204.

The inner valve member 260*a* moves up and down to operate the pump 200'. In the lower or priming position of FIG. 6, the liquid inlet gate valve 222 is open and the air valve 282' is closed. In the upper or actuating position (not shown), the liquid inlet gate valve 222 is closed and the air valve 282' is open, with inlet 285' aligned with inlet 286'.

In some embodiments, the inner liquid inlet gate valve 266 of pump 200 may be functionally replaced by one-way check valves 288' placed in the liquid inlet 265 of the inner valve member 260*a*. Such valves 288' may be, for example, any of the types identified above in relation to the liquid delivery conduit 232. The one-way valves 288' permit liquid to flow from the liquid charge chamber 224, through the valves 288', and into the liquid delivery conduit 232. The opening check pressure of the valves 288' is high enough to remain closed and prevent such movement from the pressure of liquid being gravity fed into the chamber 224 from the reservoir 212. At the same time, the opening check pressure of the valves 288' is low enough to open and permit such movement from the pressure created by upward movement of the liquid piston 280 when the liquid inlet gate valve 222 is closed.

The exemplary foam pumps 100, 200 and 200' may allow for a simple and inexpensive replacement of the liquid supply in a foam dispenser system. Once the supply of foamable liquid in the liquid reservoir runs out, the now-empty disposable refill unit 101, 201 or 201' may be replaced with a new refill unit containing a supply of foamable liquid. In this way, only two air connections need to be unmade to remove the empty refill unit and then re-made to insert the new refill unit. No liquid connections need to be made or unmade as part of this process, because the entire liquid delivery path is disposed within the refill unit. Also, the refill units are advantageous for shipping, as they permit an external locking system (not shown) to keep liquid from leaking out of the refill unit. In addition, the size of the foamable pump is significantly reduced by because the air pumps are not attached, which favorably impacts shipping and reduces the environmental impact footprint of the disposable foam pump refills.

The exemplary foam pumps 100, 200 and 200' may permit easy adjustment or tuning of the amount and the consistency of the foam being dispensed. In the pump 100, those properties may be controlled by varying the volume and pressure of the air delivered by the first and second air pumps 104, 106. In the pumps 200 and 200', those properties may be controlled by varying the upward and downward movement of the liquid piston 280 and the volume and pressure of the air delivered by the second air pump 206 upon actuation. In particular in this regard, the movement of the liquid piston 280 can be controlled by varying in time the "blow" and "vacuum" conditions of the first air pump 204.

The exemplary foam pumps 100, 200 and 200' may separate all pressure generation elements from the wetted surfaces. That is, each air pump is part of the foam dispenser system which receives the disposable refill units. The disposable refill units contain the liquid reservoir and all surfaces which are wetted by the stored liquid.

Figure 7:
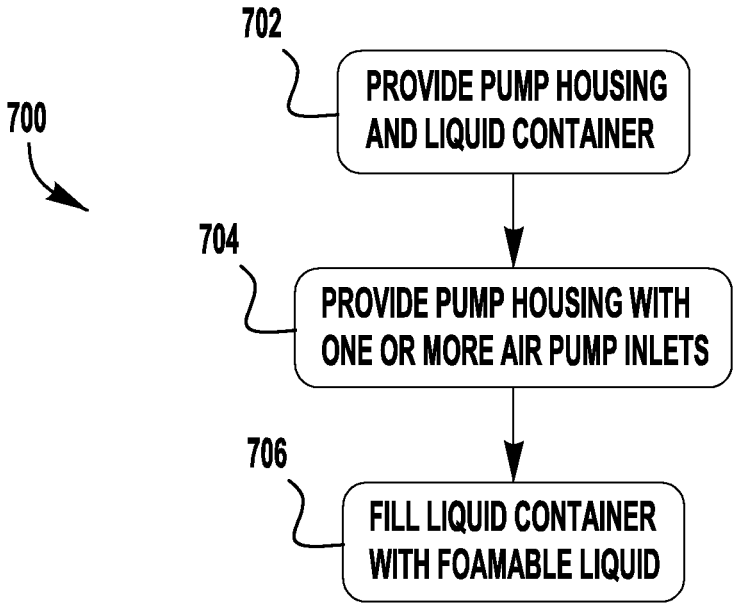
FIG. 7 illustrates an exemplary method 700 for producing a removable and replaceable refill unit for a foam dispenser.

FIG. 7 illustrates an exemplary method 700 for producing a removable and replaceable refill unit for a foam dispenser. Although the exemplary method is presented in a specific order, no particular order is required to perform these steps, and various combinations or groupings of different steps may be used in accordance with the present invention. The exemplary method 700 includes providing 702 a pump housing and a liquid container for holding a supply of foamable liquid. The pump housing is provided 704 with at least one, but preferably two, air pump inlets for connecting to one or more air pumps which are external to the housing. The pump housing of the refill unit does not contain any internal air pumps. Rather, the one or more external air pumps provide pressurized air to propel liquid through the refill unit and to generate foam with the liquid. The pump housing may be further provided with any one or more of the structural or functional properties already identified above. The liquid container is filled 706 with a foamable liquid, and is ready for shipment.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. For example, one single air pump may be used both for liquid propulsion and for foam generation. Such a single air pump could be employed in combination with the pump 200, for example, by adding stopping elements such as snap rings in the bore 263 to limit the movement of the liquid piston 280 between upper and lower maximal positions. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A refill unit for refilling a foam dispenser system, the refill unit comprising:

a container for holding a supply of foamable liquid; and a pump housing connected to the container, the pump housing comprising a first connection for connecting to a first air pump, wherein the first air pump supplies a first source of air pressure to move the foamable liquid into a mixing chamber, a first member for preventing liquid from flowing through the first connection into the first air pump; and a second connection for connecting to a second air pump, wherein the second air pump supplies a second source of air pressure to mix air with the liquid in the mixing chamber and create a foamy air-liquid mixture; and a liquid charge chamber that has a priming state and wherein when the liquid charge chamber is in the priming state, air in the liquid charge chamber flows into the container.

2. The refill unit of claim 1, wherein the first member is a first valve member.

3. The refill unit of claim 1, wherein the pump housing further comprises a liquid charge chamber for receiving liquid from the liquid container, and the first member is an air piston disposed within the liquid charge chamber, such that a positive air pressure delivered by the first air pump when connected to the first connection causes the air piston to move in a first direction within the liquid charge chamber to move the foamable liquid into the mixing chamber, and a negative air pressure delivered by the first pump when connected to the first connection causes the air piston to move in a second direction within the liquid charge chamber which is opposed to the first direction, allowing the liquid charge chamber to fill with liquid.

4. A refill unit for refilling a foam dispenser system, the refill unit comprising:

a container for holding a supply of foamable liquid; and a pump housing connected to the container, the pump housing comprising a first connection for connecting to a first air pump, wherein the first air pump supplies a first source of air pressure to move the foamable liquid into a mixing chamber;

a first member for preventing liquid from flowing through the first connection into the first air pump; and a second connection for connecting to a second air pump, wherein the second air pump supplies a second source of air pressure to mix air with the liquid in the mixing chamber and create a foamy air-liquid mixture;

wherein the first member is a first valve member; and a second valve member movably disposed in the pump housing between a priming position and an actuating position.

5. The refill unit of claim 4, wherein the second valve member comprises a liquid delivery conduit for carrying liquid from a liquid charge chamber to the mixing chamber.

6. The refill unit of claim 5, further comprising a liquid outlet valve disposed between an outlet of the liquid delivery conduit and the mixing chamber.

7. The refill unit of claim 4, wherein the second valve member is a unitary valve member.

8. The refill unit of claim 7, wherein the pump housing further comprises a liquid charge chamber for receiving liquid from the liquid container, and an intermediate air chamber connected to the first air pump; and wherein the first valve member comprises a first wiper seal attached to the second valve member, the first wiper seal separating the liquid charge chamber from the intermediate air chamber.

9. The refill unit of claim 8, wherein the second valve member further comprises a second wiper seal separating the intermediate air chamber from the mixing chamber.

10. A refill unit for refilling a foam dispenser system, the refill unit comprising:

a container for holding a supply of foamable liquid; and a pump housing connected to the container, the pump housing comprising a first connection for connecting to a first air pump, wherein the first air pump supplies a first source of air pressure to move the foamable liquid into a mixing chamber;

a first member for preventing liquid from flowing through the first connection into the first air pump; and a second connection for connecting to a second air pump, wherein the second air pump supplies a second source of air pressure to mix air with the liquid in the mixing chamber and create a foamy air-liquid mixture; and a valve member having an inner valve member movably received within a central channel of an outer valve member, and the outer valve member is movably received within a central bore of the pump housing.

11. The refill unit of claim 10, wherein the outer valve member comprises a liquid inlet at a top of the outer valve member in the shape of an annular counterbore surrounding the central channel of the outer valve member.

12. The refill unit of claim 10, further comprising an inner liquid inlet valve disposed between the inner valve member and the outer valve member, wherein the inner liquid inlet valve leads to a liquid delivery conduit disposed within the inner valve member.

13. The refill unit of claim 12, further comprising an outer liquid inlet valve disposed between the liquid container and the pump housing.

14. A foam pump comprising:

a housing having a first connection port for connecting to a first air source;

a second connection port for connecting to a second air source;

a charging chamber having a liquid inlet for allowing liquid to enter the charging chamber;

a sealing valve to seal the liquid inlet and prevent liquid from exiting the housing through the liquid inlet;

a liquid passage between the charging chamber and a mixing chamber;

an air passage from the second air inlet to the mixing chamber; and a foam outlet located downstream of the mixing chamber;

wherein air flowing through the first connection port causes liquid to flow from the charging chamber through the liquid passage to the mixing chamber;

wherein air flowing through the second connection port flows through the air passage to the mixing chamber wherein the air mixes with the liquid and forces the mixture out of the foam outlet; and wherein when the charging chamber is in the priming state, air in the liquid charging chamber flows into the container.

15. A foam pump comprising:

a housing having a first connection port for connecting to a first air source;

a second connection port for connecting to a second air source;

a charging chamber having a liquid inlet for allowing liquid to enter the charging chamber;

a sealing valve to seal the liquid inlet and prevent liquid from exiting the housing through the liquid inlet;

a liquid passage between the charging chamber and a mixing chamber;

an air passage from the second air inlet to the mixing chamber; and a foam outlet located downstream of the mixing chamber;

wherein air flowing through the first connection port causes liquid to flow from the charging chamber through the liquid passage to the mixing chamber;

wherein air flowing through the second connection port flows through the air passage to the mixing chamber wherein the air mixes with the liquid and forces the mixture out of the foam outlet; and wherein when the charging chamber is in the priming state, air in the liquid charging chamber flows into the container; and a sealing member located between the first air inlet port and the charging chamber.

16. The foam pump of claim 15 wherein the sealing member is a piston that moves under pressure to force liquid out of the charging chamber.

17. A foam pump comprising:

a housing having a first connection port for connecting to a first air source;

a second connection port for connecting to a second air source;

a charging chamber having a liquid inlet for allowing liquid to enter the charging chamber;

a sealing valve to seal the liquid inlet and prevent liquid from exiting the housing through the liquid inlet;

a liquid passage between the charging chamber and a mixing chamber;

an air passage from the second air inlet to the mixing chamber;

a foam outlet located downstream of the mixing chamber;

wherein air flowing through the first connection port causes liquid to flow from the charging chamber through the liquid passage to the mixing chamber; and wherein air flowing through the second connection port flows through the air passage to the mixing chamber wherein the air mixes with the liquid and forces the mixture out of the foam outlet, further comprising a sealing member located between the first air inlet port and the charging chamber; and a sealing member located between the first air inlet port and the charging chamber;

wherein the sealing member is a wiper seal that allows air under pressure to pass by and force liquid out of the charging chamber.

18. A foam pump comprising:

a housing having a first connection port for connecting to a first air source;

a second connection port for connecting to a second air source;

a charging chamber having a liquid inlet for allowing liquid to enter the charging chamber;

a sealing valve to seal the liquid inlet and prevent liquid from exiting the housing through the liquid inlet;

a liquid passage between the charging chamber and a mixing chamber;

an air passage from the second air inlet to the mixing chamber;

a foam outlet located downstream of the mixing chamber;

wherein air flowing through the first connection port causes liquid to flow from the charging chamber through the liquid passage to the mixing chamber; and wherein air flowing through the second connection port flows through the air passage to the mixing chamber wherein the air mixes with the liquid and forces the mixture out of the foam outlet; and a first movable valve member that seals the liquid inlet and opens the liquid passage.

19. The foam pump of claim 18 further comprising a second movable valve member, wherein the first movable valve member and second movable valve member are coaxial and the first movable valve member moves within the second movable valve member.

20. A refill unit for a foam dispenser comprising:

a container;

a pump housing having a connector for connecting to the container;

a pump housing having a first connection port for connecting to a first air source;

a second connection port for connecting to a second air source;

a charging chamber having a liquid inlet for allowing liquid to enter the charging chamber;

a sealing valve to seal the liquid inlet and prevent liquid from exiting the housing through the liquid inlet;

a liquid passage between the charging chamber and a mixing chamber;

an air passage from the second air inlet to the mixing chamber; and a foam outlet located downstream of the mixing chamber;

wherein air flowing through the first connection port causes liquid to flow from the charging chamber through the liquid passage to the mixing chamber; and wherein air flowing through the second connection port flows through the air passage to the mixing chamber wherein the air mixes with the liquid and forces the mixture out of the foam outlet; and wherein when the charging chamber is in the priming state, air in the charging chamber flows into the container.

* * * * *